US010600316B1

(12) United States Patent
Dziduch et al.

(10) Patent No.: US 10,600,316 B1
(45) Date of Patent: Mar. 24, 2020

(54) RULES-BASED METHOD OF IDENTIFYING MISUSE OF EMERGENCY FIRE EXITS USING DATA GENERATED BY A SECURITY ALARM SYSTEM

(71) Applicant: Johnson Controls Technology Company, Auburn Hills, MI (US)

(72) Inventors: Marcin Dziduch, Cork (IE); Abdul Razak, Cork (IE); Conor Joseph Donovan, Bishoptown (IE)

(73) Assignee: Johnson Controls Technology Company, Auburn Hills, MI (US)

( * ) Notice: Subject to any disclaimer, the term of this patent is extended or adjusted under 35 U.S.C. 154(b) by 0 days.

(21) Appl. No.: 16/274,071

(22) Filed: Feb. 12, 2019

(51) Int. Cl.
*G08B 27/00* (2006.01)
*G08B 29/02* (2006.01)
*G08B 25/00* (2006.01)

(52) U.S. Cl.
CPC ..... *G08B 29/02* (2013.01); *G08B 25/001* (2013.01)

(58) Field of Classification Search
CPC ..... G08B 7/066; G08B 7/062; G08B 29/02; G08B 25/001; G09F 13/04; G09F 19/22
See application file for complete search history.

(56) References Cited

U.S. PATENT DOCUMENTS 10,026,278 B1 * 7/2018 Asaro ..... G08B 7/062
2002/0190857 A1 * 12/2002 Chicca ..... G08B 25/08 340/531
2009/0138353 A1 * 5/2009 Mendelson ..... G01C 21/206 705/14.39
2014/0159910 A1 * 6/2014 Lee ..... G08B 7/066 340/691.6
2016/0049071 A1 * 2/2016 Beaver ..... G08B 29/185 340/514
2018/0293858 A1 * 10/2018 Carter ..... G08B 17/00
2019/0318612 A1 * 10/2019 Melman ..... G08B 29/14

* cited by examiner

*Primary Examiner* — Munear T Akki
(74) *Attorney, Agent, or Firm* — Foley & Lardner LLP

(57) ABSTRACT

A rules-based emergency exit misuse identification system, including one or more cloud servers. The one or more cloud servers are configured to store instructions to be executed on one or more security systems. The one or more security systems are configured to receive emergency data from a plurality of sensors for a plurality of emergency exits, the emergency data indicating activity of the plurality of emergency exits. The one or more security systems are configured to identify one or more emergency exits for which a burglar alarm event occurred. The one or more security systems are configured to identify past burglar alarm events associated with the one or more emergency exits for which the burglar alarm event occurred. The one or more security systems are configured to determine if the burglar alarm event qualifies as a delay event. The one or more security systems are configured to register and save the emergency data including the burglar alarm event if the burglar alarm qualifies as a delay event. The one or more security systems are configured to generate system recommendations for prevention of future delay events for the plurality of emergency exits. The one or more security systems are configured to generate a report including details of the delay event, emergency exit activity and historical data collected from the plurality of sensors for the plurality of emergency exits.

20 Claims, 6 Drawing Sheets

600

620

← BACK

602

EVENT REPORT 612 604 606 608 610

| Time Stamp | Zone | Exit | Cancellation Event (Y/N) |
|---|---|---|---|
| Jul-06 04:12:56 | A | 1 | Yes |
| Jul-11 14:52:08 | B | 2 | Yes |
| Jul-12 21:36:41 | C | 3 | No |

614

Time Period: 14 days (Jul-01 – Jul-15)

616

3 new events occurred in this time period

618

Recommendation: Completed →

FIG. 6

RULES-BASED METHOD OF IDENTIFYING MISUSE OF EMERGENCY FIRE EXITS USING DATA GENERATED BY A SECURITY ALARM SYSTEM

BACKGROUND

The present disclosure relates generally to identifying misuse of emergency exits. The present disclosure relates more particularly to identifying misuse of emergency exits using data generated by a security alarm system.

Emergency exits can be equipped with alarms that can detect when the emergency exit has been opened and initiate emergency procedures accordingly. In the instance of a false alarm, execution of emergency procedures can be costly in terms of time, money, annoyance of building occupants, and resources. In order to reduce the likelihood of false alarms, common standard practices can include prohibiting use of emergency exits under conditions that do not warrant an emergency. Misuse of emergency exits can not only damage emergency exits and associated monitoring but can also cause alarms that can be ignored.

Emergency exit usage can be unexpected and difficult to predict. Various factors can influence emergency exit use in both emergency and non-emergency situations including personnel and activity within or around a building or area, among other factors. With many factors capable of influencing use of emergency exits, identifying proper and improper usage of emergency exits is challenging.

SUMMARY

One implementation of the present disclosure is a rules-based emergency exit misuse identification system. The system includes one or more cloud servers configured to store instructions to be executed on one or more security systems. The one or more security systems are configured to receive emergency data from one or more sensors for one or more emergency exits. The one or more security systems are configured to identify one or more emergency exits for which a burglar alarm event occurred and identify past burglar alarm events associated with the one or more emergency exits for which the burglar alarm event occurred. The one or more security systems are configured to determine if the burglar alarm event qualifies as a delay event and register and save the emergency data including the burglar alarm event if the burglar alarm qualifies as a delay event. The one or more security systems are configured to generate system recommendations for prevention of future delay events for the plurality of emergency exits and generate a report including details of the delay event, emergency exit activity and historical data collected from the plurality of sensors for the plurality of emergency exits.

In some embodiments, the one or more security systems are configured to determine if a door open event or a door close event occurred within a first defined time period of the burglar alarm event, and if a door open event or a door close event occurred within the first defined time period of the burglar alarm event, determine if an alarm cancellation event occurred within a second defined time period of the burglar alarm event. The one or more security systems can also be configured to, if an alarm cancellation event occurred within the second defined time period of the burglar alarm event, classify the burglar alarm event as a delay event.

In some embodiments, the one or more security systems are configured to classify the burglar alarm as a non-delay event if it is determined that a door open event or a door close event occurred within the first defined time period of the burglar alarm or an alarm cancellation event occurred within the second defined time period of the burglar alarm event.

In some embodiments, the one or more security systems are configured to generate system recommendations in response to the burglar alarm event qualifying as a delay event, the system recommendations generated by analyzing the emergency exit data collected from the one or more sensors for the one or more emergency exits.

In some embodiments, the one or more security systems are configured to generate, in response to the burglar alarm event qualifying as a delay event, by analyzing the emergency exit data collected from the plurality of sensors for the plurality of emergency exits.

In some embodiments, the one or more security systems are configured to communicate the system recommendations to one or more user devices.

In some embodiments, the one or more security systems are configured to communicate the report to the one or more user devices.

In some embodiments, the one or more security systems are configured to transmit the emergency data from the plurality of sensors for the plurality of emergency exits indicating activity of the plurality of emergency exits is transmitted to the one or more cloud servers through a network.

In some embodiments, the one or more security systems are configured to include the first defined time period within which a door open event or a door close event occurs is adjustable.

In some embodiments, the one or more security systems are configured to include the second defined time period within which an alarm cancellation event occurs is adjustable.

Another implementation of the present disclosure is a method for identifying misuse of emergency exits. The method includes receiving emergency data from one or more sensors for one or more emergency exits, the emergency data indicating activity of the one or more emergency exits. The method includes communicating, to a network, the received emergency exit data and identifying one or more emergency exits for which a burglar alarm event occurred. The method includes identifying past burglar alarm events associated with the one or more emergency exits for which the burglar alarm event occurred and determining if the burglar alarm event qualifies as a delay event. The method includes registering and save the emergency data including the burglar alarm event if the burglar alarm qualifies as a delay event and generating system recommendations for prevention of future delay events for the one or more emergency exits. The method includes generating a report including details of the delay event, emergency exit activity and historical data collected from the plurality of sensors for the plurality of emergency exits.

In some embodiments, the method further includes determining if a door open event or a door close event occurred within a first defined time period of the burglar alarm event, and if a door open event or a door close event occurred within the first defined time period of the burglar alarm event, determining if an alarm cancellation event occurred within a second defined time period of the burglar alarm event. The method can further include, if an alarm cancellation event occurred within the second defined time period of the burglar alarm event, classifying the burglar alarm event as a delay event.

In some embodiments, the method further includes classifying the burglar alarm as a non-delay event if it is determined that a door open event or a door close event occurred within the first defined time period of the burglar alarm or an alarm cancellation event occurred within the second defined time period of the burglar alarm event.

In some embodiments, the method further includes generating system recommendations in response to the burglar alarm event qualifying as a delay event, the system recommendations generated by analyzing the emergency exit data collected from the one or more sensors for the one or more emergency exits.

In some embodiments, the method further includes generating, in response to the burglar alarm event qualifying as a delay event, by analyzing the emergency exit data collected from the one or more sensors for the plurality of emergency exits.

In some embodiments, the method further includes communicating the system recommendations to one or more user devices.

In some embodiments, the method further includes communicating the report to the one or more user devices.

In some embodiments, the method further includes adjusting the first defined time period within which a door open event or a door close event occurs.

In some embodiments, the method further includes adjusting the second defined time period within which an alarm cancellation event occurs.

Another implementation of the present disclosure is a rules-based emergency exit misuse identification system. The system includes one or more cloud servers storing instructions, and one or more security systems configured to execute the instructions stored on the one or more cloud servers. The one or more security systems are configured to receive emergency data from one or more sensors for one or more emergency exits. The one or more security systems are configured to identify one or more emergency exits for which a burglar alarm event occurred and identify past burglar alarm events associated with the one or more emergency exits for which the burglar alarm event occurred. The one or more security systems are configured to determine if the burglar alarm event qualifies as a delay event and register and save the emergency data including the burglar alarm event if the burglar alarm qualifies as a delay event. The one or more security systems are configured to generate system recommendations for prevention of future delay events for the plurality of emergency exits and generate a report including details of the delay event, emergency exit activity and historical data collected from the plurality of sensors for the plurality of emergency exits.

Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

BRIEF DESCRIPTION OF THE DRAWINGS

FIG. 6 is a user interface for a system generating a report on emergency exit usage, according to an exemplary embodiment.

DETAILED DESCRIPTION

Overview

Figure 1:
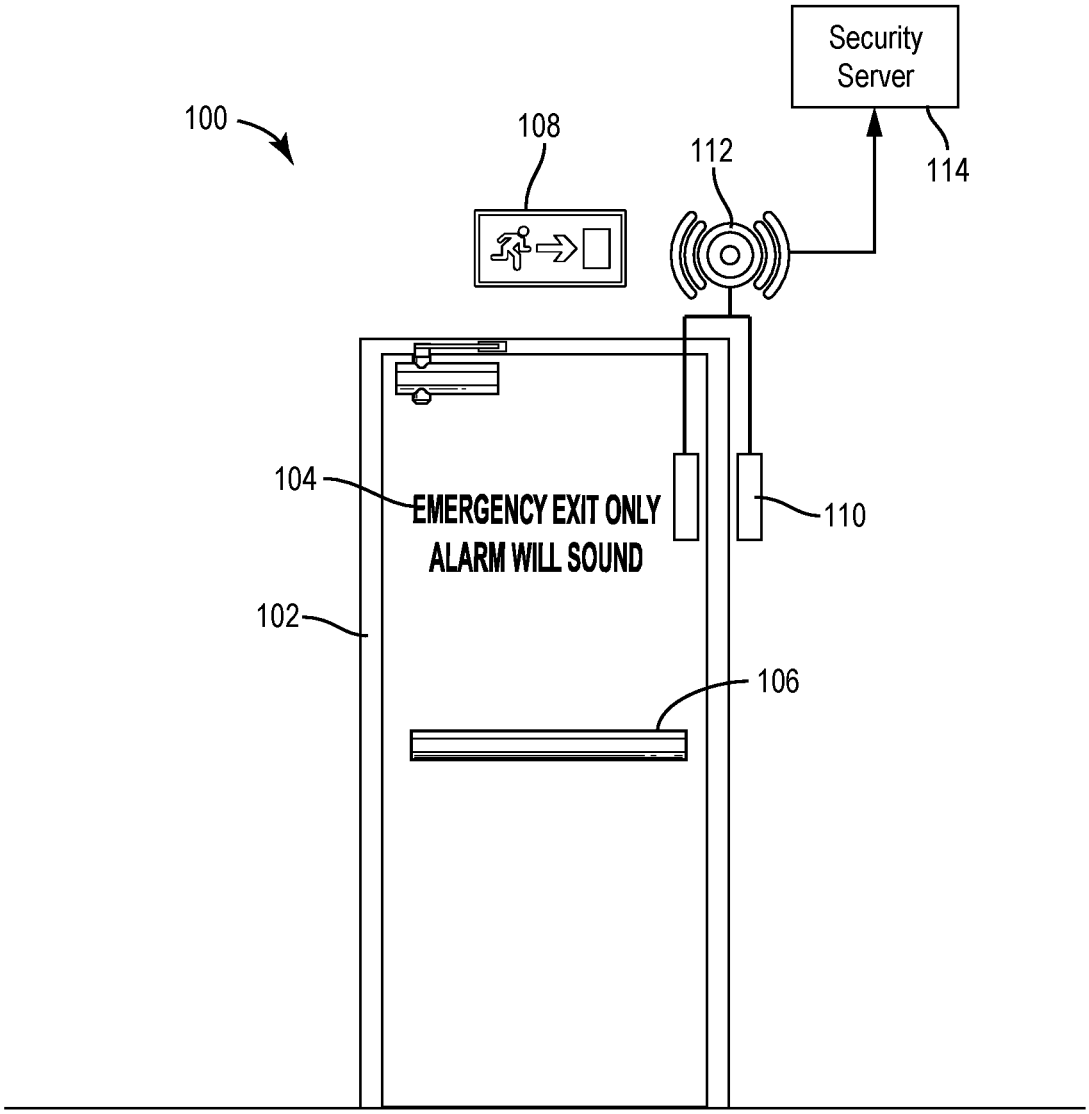
FIG. 1 is a system for emergency exit monitoring, according to an exemplary embodiment.

Buildings must have a certain number of emergency fire exits for safety reasons, and regulations require that these exits permit egress from buildings at all times. For this reason, emergency exits are kept unlocked, usually in the direction of exit. In many cases, emergency exits are located clear of high-traffic areas and are not often actively monitored by employees or security personnel. This presents a security risk, given that the exits may be used by unauthorized persons, including employees as well as intruders and thieves. Unauthorized use also presents risk of damage or improperly functioning emergency exits leaving them not only not functioning properly and not aligning with regulations, but also posing a risk to building occupants.

Most alarms carry a delay, which allows a set amount of time for an authorized user to cancel the alarm sequence. In the event of an alarm sequence being cancelled by an authorized user, deactivation usually happens by means of a key or a disarm code entered on a connected panel. Should deactivation not occur within the set amount of time, the alarm becomes active. In some systems, this triggers an automatic call to emergency services. In the event of frequent false alarms possibly stemming from misuse, alarm sequences may be ignored thus posing a security threat to a building.

Emergency exits can also present risk in the form of false alarms. False alarms can be caused by improper and/or unauthorized use of emergency exits, as well as malfunctioning equipment. In some instances, false alarms can be costly both in the form of time, resources, and possible monetary penalties. A false alarm can halt production and/or other productivity for some entities, which can cause a loss of efficiency and/or overall output. Further, in some instances a false alarm may cost an entity resources, for example in the instance that a building in which time-sensitive materials are processed must be vacated. In some jurisdictions, multiple false alarms from a single entity within a set time period can carry a fine, thus making it desirable to minimize any possible false alarms.

Emergency exits within buildings can include one or more sensors which can collect various data relating to one or more emergency exits. Some sensors can monitor position of an emergency exit such as an open or closed state for a door, while others can collect data including usage, time of usage, and duration of usage as well as other data. Emergency exit sensors can also be connected to local security systems which can include both emergency capabilities as well as security capabilities, for example burglar alarms. In some systems, emergency and security data can be collected from emergency exit sensors. Some systems including those configured to provide local security and emergency monitoring can be further configured to communicate with one or more networks. Communication between such systems and networks can include transmission of data collected by sensors that can be a part of systems. Networks can be configured to communicate data, including that received from sensors of systems that can provide security and emergency monitoring, with one or more cloud servers. Cloud servers can be configured to include security systems capable of various analyses of received data from networks. Security systems configured within cloud servers can also be configured to generate reports and recommendations based on received data and analysis thereof. Security systems within cloud servers can be further configured to prepare reports and recommendations for output to user devices, which can allow users and/or operators to consume reports and recommendations for emergency exits and security and take appropriate action.

Identifying Misuse of Emergency Exits

Referring to FIG. 1, a system for emergency exit monitoring 100 is shown, according to some embodiments. System 100 can include various components, according to some embodiments. For example, system 100 can include alarm systems and sensors, among other components, for monitoring an emergency exit for a building or a system of buildings. System 100 can also be configured and/or modified in order to operate according to user and/or operator preferences. For example, in some embodiments system 100 can be configured to provide various levels of emergency exit security according to preferences of a user and/or operator. Further, system 100 can also be configured according to a building. For example, system 100 can be configured differently to accommodate various emergency exits that can include one or multiple doors or other points of entry or egress. System 100 can also be configured to operate in conjunction with one or more other systems, according to some embodiments.

System 100 can include an emergency exit door 102, according to some embodiments. Emergency exit door 102 can in some embodiments, and can include a system with multiple doors, for example. Emergency exit door 102 can be configured in various locations within a building or a system of buildings and can be also be configured according to user and/or operator preference. Emergency exit door 102 can include emergency signage 104, according to some embodiments. Emergency signage 104 can be configured according to user and/or operator preferences, and can also be configured according to a building and/or surrounding area. For example, emergency signage 104 can include one or more languages, and can also indicate alternate exits or procedures in some embodiments. Emergency signage 104 can, for example, function so as to alert personnel that emergency exit door 102 is part of system 100 and can also alert personnel that emergency exit door 102 is equipped with an alarm. Emergency exit door 102 can also include a crash bar 106, according to some embodiments. Emergency exit door 102 can also include other mechanisms for opening, such as a handle, knob, or other interface according to some embodiments.

System 100 is shown to include an emergency exit indicator 108, according to some embodiments. Configuration and placement of emergency exit indicator 108 can vary according to some embodiments and user and/or operator preference, as well as building codes and regulations. Emergency exit indicator 108 can also be configured to be illuminated some or all of the time so as to function in a situation where vision can be obscured. Additionally, the content of emergency exit indicator 108 can vary in some embodiments. For example, emergency exit indicator 108 can indicate that an emergency exit is in a certain direction in order to direct personnel in an emergency situation, particularly if visibility may be limited. As such, emergency exit indicator 108 can vary according to some embodiments in order to address different locations of one or more emergency exits and emergency exit systems such as system 100.

System 100 is also shown to include a pair of door contacts 110, according to some embodiments. Pair of door contacts 110 can be configured so as to have one door contact coupled to emergency exit door 102, and the other door contact coupled to a surface adjacent to emergency exit door 102 such as a wall, according to some embodiments. In some embodiments, an emergency exit such as emergency exit door 102 or similar can include a plurality of pairs of door contacts that can be the same as or similar to pair of door contacts 110. Pair of door contacts 110 can be connected and in communication with an alarm 112 in some embodiments. Other door sensors can be utilized including but not limited to limit switches, capacitive sensors, inductive sensors, light sensors, etc. Alarm 112 can provide alerts through a number of different means including audible alarms, visual alarms, remote alarms, as well as other alert mechanisms. For example, alarm 112 can be connected and in communication with pair of door contacts 110 and, upon receiving data from pair of door contacts 110 become active should the data from pair of door contacts 110 indicate a situation necessitating alarm activity. Given a situation in which pair of door contacts 110 can communicate data to alarm 112 necessitating an alarm can include emergency exit door 102 being ajar or not properly shut as well as other possible events, according to some embodiments.

System 100 is shown to include a security server 114, according to some embodiments. In some embodiments, security server 114 can be connected to and in communication with alarm 112, which in turn can be connected to and in communication with pair of door contacts 110 or other door sensor. Security server 114 can also be in communication with other door contacts similar to pair of door contacts 110 as well as other alarms similar to alarm 112 that can correspond to other systems similar to system 100. For example, security server 114 can be connected to and in communication with another emergency exit similar to emergency exit door 102 and can be capable of activating alarm 112 in response to events detected at an emergency exit other than emergency exit door 102. Security server 114 can also be configured to communicate with systems that can be similar to system 100 that may exist for other buildings and/or parts of a building, according to some embodiments.

Figure 2:
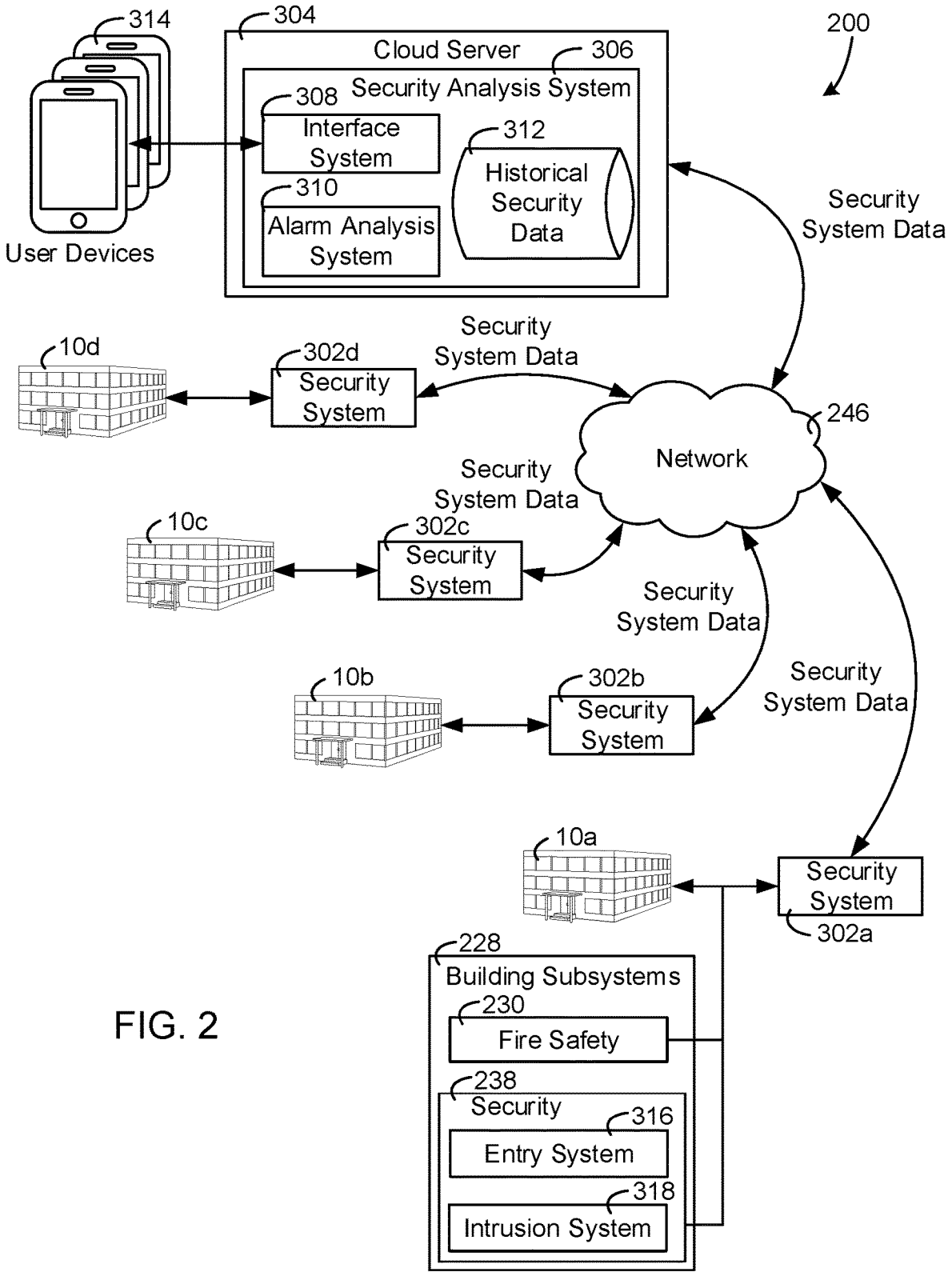
FIG. 2 is a system for monitoring the security of building subsystems, according to an exemplary embodiment.

Referring now to FIG. 2, a cloud-based security system 200 is shown, according to some embodiments. In some embodiments, system 200 can monitor security of building subsystems. System 200 is shown to include building subsystems 228. Building subsystems 228 include a fire safety subsystem 230 and a security subsystem 238, according to some embodiments. Security subsystem 238 is shown to include an entry system 316 and an intrusion system 318, according to some embodiments. Entry system 316 can include standard entry doors, emergency exits, utility doors, cargo entries, garage entrances as well as other possible points of entry to a building 10*a* or other similar building. Intrusion system 318 can include all points to entry or exit of entry system 316 but can also include windows and other possible locations where prevention of intrusion may be desired. Fire safety subsystem 230 can include fire alert mechanisms as well as fire prevention mechanisms and can be configured throughout building 10*a* similar to entry system 316 and intrusion system 318. Fire safety subsystem 230 can be designed to work in conjunction with entry system 316 and intrusion system 318 in order to monitor the usage of emergency and fire exits, as well as other points of potential intrusion or egress.

System 200 is shown to include a security system 302*a*, according to some embodiments. Similarly, system 200 is also shown to include security systems 302*b*-302*d* which can be the same or similar to security system 302*a*, according to some embodiments. Building subsystems 228 are shown to be a part of security system 302*a*, according to some embodiments. Security system 302*a* can be a part of an overall security system spanning multiple buildings, according to some embodiments, which can include security systems 302*a-d* and/or other similar systems as well as buildings 10*a-d* and/or other similar buildings, according to some embodiments. In some embodiments in which security system 302*a* can provide security for multiple buildings such as buildings 10*a*-10*d*, possible points of entry monitored by entry system 316 and possible points of intrusion monitored by intrusion system 318 can be monitored further by corresponding security systems 302*a*-302*d*. Buildings 10*a*-10*d* can also include fire safety subsystem 230 or other similar system for each building. It should be noted that the specific areas of buildings monitored can vary depending on a number of factors including building size, location, footprint, geography, function, and contents as well as other factors specific to a building or group of buildings that can require additional, lesser or alternative monitoring by building subsystems 228.

Security systems 302*a*-302*d* can be in communication with a network 246, according to some embodiments. Security systems 302*a-d* can also be configured to send security system data that can be collected from a plurality of buildings to network 246. Network 246 can be configured to be in communication with one or more security systems, according to some embodiments. Further, network 246 can be configured to communicate a variety of data that may pertain to security systems 302*a-d* and/or buildings 10*a-d* or similar. In some embodiments, security system data can be collected by components such as pair of door contacts 110 of system 100 seen in FIG. 1 or other similar components. Security system data communicated between security systems 302*a-d* can include data collected from buildings 10*a-d* with the data pertaining to building subsystems 228 including fire safety subsystem 230 as well as security subsystem 238, entry system 316 and intrusion system 318, according to some embodiments.

Network 246 is shown to be in communication with cloud server 304, according to some embodiments. In some embodiments, network 246 can be in communication with one or more servers that may be the same as or similar to cloud server 304. Cloud server 304 is shown to include security analysis system 306, which is in turn shown to include an interface system 308, an alarm analysis system 310 and historical security data 312. In some embodiments, interface system 308 can be configured to interface with user devices 314. User devices 314 can include smartphones, tablets, laptops, and personal computers as well as other possible devices. Alarm analysis system 310 can be configured according to user and/or operator preferences in some embodiments. For example, alarm analysis system can be configured to identify emergency exit use on certain days or during certain hours or may further be configured to identify possible patterns relating to false alarms. Historical security data 312 can originate from systems that may be in place in buildings 10*a-d* and/or other similar buildings. In some embodiments, historical security data can vary according to user and/or operator preference. For example, historical security data 312 can include past alarms, emergency events, and false alarms as well as other historical data. In some embodiments, cloud server 304 can be configured according to user and/or operator preferences. For example, in some embodiments cloud server 304 can have specific capacities, connection capabilities or communication capabilities specific to one or more systems and/or buildings. Data collected from security system 302*a*-302*d* can be sent to network 246 and then subsequently sent to cloud server 304, which contains security analysis system 306.

Figure 3:
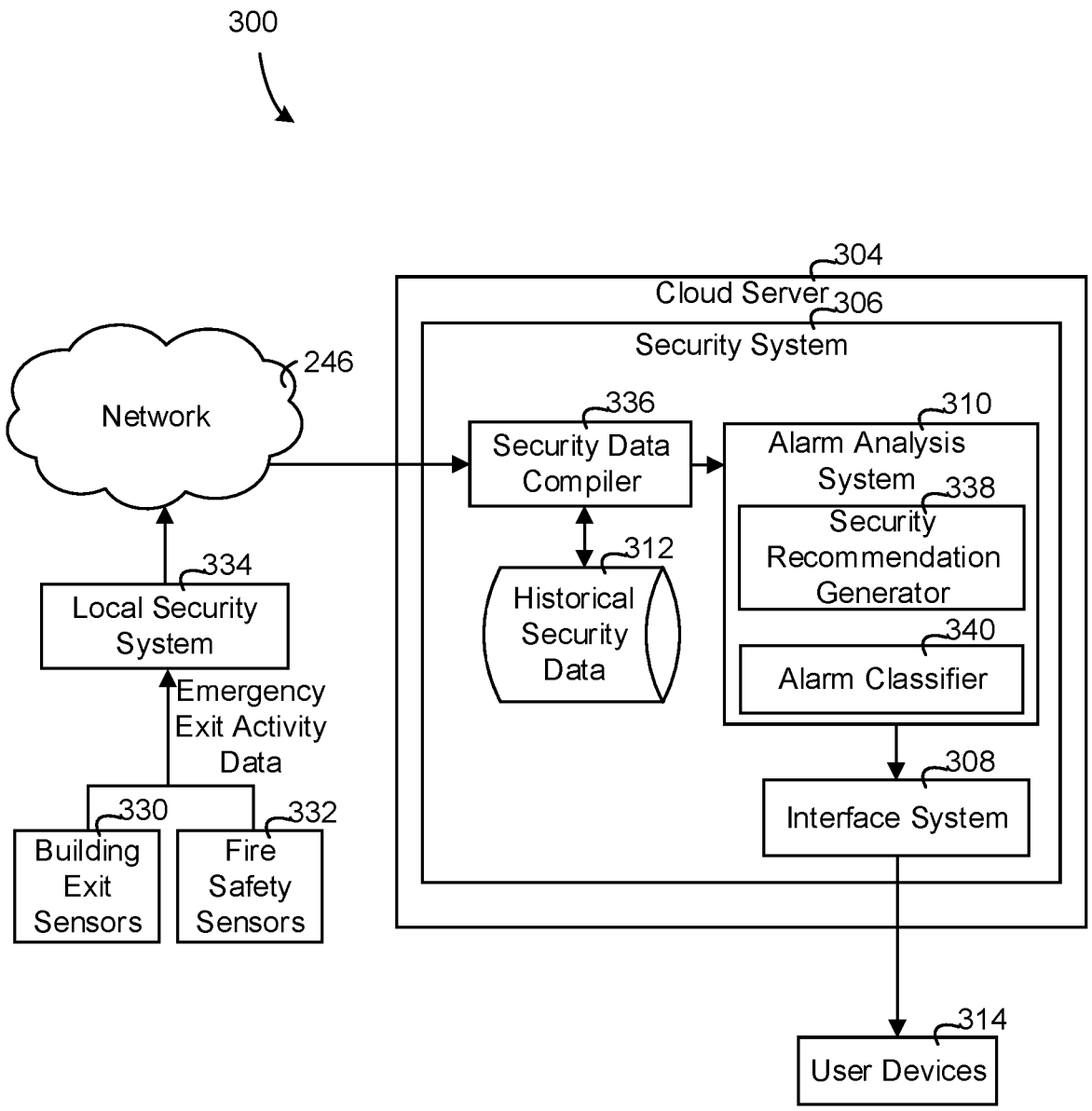
FIG. 3 is a building security system communicating with a cloud-based security system, according to an exemplary embodiment.

Referring now to FIG. 3, a system 300 for security analysis is shown, according to some embodiments. In some embodiments, system 300 can include components that can be present in system 200. Further, system 300 can function cooperatively and/or in parallel with system 200, according to some embodiments. System 300 can also be in communication with one or more security systems such as security systems 302*a-d* of FIG. 2 and may also be in communication with one or more buildings such as buildings 10*a-d* also of FIG. 2, according to an exemplary embodiment. System 300 can also implement various techniques in analyzing security for one or more buildings and/or security systems. In some embodiments, analysis techniques implemented by system 300 can be modified to accommodate user and/or operator preferences. For example, if a user and/or operator wanted to analyze activity for specific exits or a specific time of day, system 300 can be configured to perform security analyses accordingly.

System 300 is shown to include building exit sensors 330 and fire safety sensors 332. Building exit sensors 330 can be placed at possible points of exit for a building, which can include doorways, emergency exits, loading/cargo exits, as well as other possible exits. Fire safety sensors 332 can be placed at the same locations as the building exit sensors 330 or can be placed at other locations within a building. In some embodiments, building exit sensors 330 and fire safety sensors 332 may be contained to one housing and/or function cooperatively. Further, building exit sensors 330 and fire safety sensors 332 can also be configured to function in conjunction with one another, for example both building exit sensors 330 and fire safety sensors 332 can be configured to share a power supply. Additionally, it should be noted that the placement of building exit sensors 330 and fire safety sensors 332 can vary depending on a number of factors including building function, geography, footprint, and size, among other factors including user and/or operator preference. It should also be noted that building exit sensors 330 and fire safety sensors 332 can be components of fire safety subsystem 230, entry system 316, and intrusion system 318 of FIG. 2, according to some embodiments.

Building exit sensors 330 and fire safety sensors 332 can send emergency exit activity data to a local security system 334. Local security system 334 can include one building or can include multiple buildings, depending on the embodiment. Additionally, local security system 334 can be a part of a system that includes multiple local security systems. Emergency exit activity data collected by building exit sensors 330 and fire safety sensors 332 can include time stamped event data for a specific location, or a cue to trigger an alert system, according to some embodiments. Further, emergency exit activity data collected and transmitted by building exit sensors 330 can be the same and/or different than that of fire safety sensors 332. Local security system 334 can also be in communication with network 246, according to some embodiments. In some embodiments, local security system 334 can be in communication with multiple networks the same as and/or similar to network 246. Local security system 334 can also be configured to accommodate one or more buildings such as buildings 10*a-d* of FIG. 2, according to some embodiments. Network 246 can be the same as or similar to network 246 of FIG. 2 and can also be in communication with a plurality of local security systems such as local security system 334 or similar, as well as a plurality of other systems similar to system 300. Network 246 can also be configured according to user and/or operator preferences. For example, if a user and/or operator desired different data collection and analysis parameters for data collected from building exit sensors 330 and fire safety sensors 332, network 246 can be configured accordingly.

Network 246 is shown to be in communication with components configured within security analysis system 306, which is configured within cloud server 304, according to some embodiments. In some embodiments, cloud server 304 and security analysis system 306 can be the same as or similar to that of FIG. 2. Further, cloud server 304 and security analysis system 306 can be in communication with one or more networks the same as or similar to network 246, according to some embodiments. In some embodiments, network 246 can be configured to send and/or receive data to and from with components configured within cloud server 304 and security analysis system 306.

Security analysis system 306 is shown to include a security data compiler 336, according to some embodiments. In some embodiments, security data compiler 336 can be in communication with network 246 and can be configured to receive data from network 246 which can include emergency exit activity data such as that collected from building exit sensors 330 and fire safety sensors 332. Security data compiler 336 can serve to compile data which can include emergency exit activity data received from network 246 and also organize any received data, according to some embodiments. In some embodiments, security data compiler 336 can compile data according to user and/or operator preferences. For example, if a user and/or operator desired different analyses for different data received by security data compiler 336, then said received data may be compiled according to preferred analysis technique. Security data compiler 336 can also receive historical security data 312 which can be the same as or similar to that seen in FIG. 2, according to some embodiments. Historical security data 312 can include multiple different forms of data. For example, historical security data 312 can include a log showing previous emergency exit usage in order to allow for future identification of exit usage patterns. Further, historical security data 312 can include emergency exit testing times, or other instances in which emergency exits can be acceptably used outside of an emergency situation that would ultimately allow for identification of emergency exit usage as acceptable. Security data compiler 336 can also store compiled data received from network 246 in historical security data 312 as it is complied. For example, upon receiving data from network 246 security data compiler 336 can compile received data and also store the received data while also receiving data from the historical security data 312 for compilation with recently received data.

Security analysis system 306 is shown to include alarm analysis system 310, according to some embodiments. In some embodiments, security data compiler 336 is shown to be communication with alarm analysis system 310. In some embodiments, alarm analysis system 310 can be the same and/or similar to that of FIG. 2. In some embodiments, alarm analysis system 310 can be configured to perform a variety of analyses. For example, data collected by building exit sensors 330 may require different analyses than data collected by fire safety sensors 332. As such, alarm analysis system 310 may perform different analyses in order to accommodate different data. Alarm analysis system 310 can also be configured to perform analyses according to user and/or operator preferences. For example, if a user and/or operator desires an analysis in which a daily time period is determined for which 90% of emergency exit activity data indicates events, alarm analysis system can be configured to perform that analysis.

Alarm analysis system 310 is shown to include a security recommendation generator 338 and an alarm classifier 340. Alarm analysis system 310 can perform multiple types of analysis for the received data from security data compiler 336, for example identification of potential false alarms, activity occurring during designated acceptable usage periods (e.g. testing, etc.), or other analysis functions. In some embodiments, analyzed data and any results of data analysis can be processed in order to generate recommendations and/or classify data and activity. Security recommendation generator 338 can be configured to create recommendations to prevent future misuse of emergency exits of system 300, according to some embodiments. Any recommendations generated by security recommendation generator 338 can be made based on data received by alarm analysis system 310 from security data compiler 336. In some embodiments, recommendations of security recommendation generator 338 can also be based on results of any analyses performed on received data by alarm analysis system 310. Recommendations generated by security recommendation generator 338 can include, for example, evaluating a sensor for an exit that registers frequent unacceptable usage, or increased monitoring or training to prevent misuse by employees if an emergency exit is commonly used at a specific time on certain days. Alarm classifier 340 can be configured to sort, organize, and classify the data received to alarm analysis system 310 from security data compiler 336. Alarm classifier 340 can also be configured to classify data as well as results of data that has been analyzed by alarm analysis system 310, according to some embodiments. In some embodiments, classification by alarm classifier 340 can include determining any emergency exit events that were acceptable or unacceptable usage, as well as other possible classification. In some embodiments, alarm classifier 340 can be configured according to user and/or operator preferences. Alarm classifier 340 can, in some embodiments, be further configured to classify data according to specific user and/or operator preferences and parameters. For example, if testing of an emergency exit were being conducted or an emergency evacuation drill were taking place, this can be acceptable use of emergency exits in a non-emergency situation. For such a situation, alarm classifier 340 can identify these events and distinguish these events from misuse, such as an employee routinely using an emergency exit to leave a building in a non-emergency situation that is deemed unacceptable use of an emergency exit, according to some embodiments. Security recommendation generator 338 and alarm classifier 340 can work in conjunction to prepare recommendations for system 300 based on the classification of the data compiled by security data compiler 336 and sent to alarm analysis system 310, according to some embodiments.

Security analysis system 306 is shown to include interface system 308, according to some embodiments. In some embodiments, alarm analysis system 310 is shown to be in communication with an interface system 308. Interface system 308 of FIG. 3 can be the same or similar to interface system 308 of FIG. 2, according to some embodiments. Elements of alarm analysis system 310 including security recommendation generator 338 and alarm classifier 340 can prepare data for eventual presentation to a user. In some embodiments, interface system 308 can receive data from alarm analysis system 310 and prepare data for presentation to a user through some form of user interface. In some embodiments, data received from alarm analysis system 310 can include security recommendations and alarm classifications produced by security recommendation generator 338 and alarm classifier 340. Interface system 308 can prepare data to be received by a user through a variety of means, including a traditional graphical user interface (GUI), an audible alarm sounding, haptic feedback, or other possible system notifications configured depending on system 300 and user and/or operator preferences. Interface system 308 can also be configured to generate multiple different interfaces for varying time intervals, some of which can be defined by a user and/or operator. For example, if a user and/or operator were to desire a two-day timeline, interface system 308 can generate an interface configured to include pertinent information which can include data outputted from alarm classifier 340 and security recommendation generator 338 of alarm analysis system 310. Interface system 308 can prepare data received from alarm analysis system 310 and its components therein to be sent to user devices 314, according to some embodiments. In some embodiments, interface system 308 can be in communication with one or more user devices 314.

System 300 is shown to include user devices 314, according to some embodiments. In some embodiments, user devices 314 can be configured to receive data from alarm analysis system 310 that may have been processed by interface system 308. In some embodiments, user devices 314 can be the same as or similar to user devices 314 of FIG. 2. It should be noted that according to some embodiments, user devices 314 can exist separate from cloud server 304. User devices 314 can include a variety of potential devices including but not limited to smartphones, handheld communication devices, mounted control units such as an alarm system, computers, tablets, and other central monitoring software that can allow for monitoring of data collected by any components of system 300. User devices 314 can communicate data received from and processed by interface system 308 to a user through one or more means. Means of communication between user devices 314 and one or more users can include visual feedback and alerts, audio information, alerts and alarms, haptic feedback such as from a handheld device, or other potential alert and communication mechanisms, according to some embodiments. User devices 314 can also receive data from interface system 308 for one or more buildings or building systems, or from one or more security systems, according to some embodiments. Additionally, it should be noted that data communicated to user devices 314 by interface system 308 can be specified by a user as to what a user or group of users can be authorized to view, or what data can be desirable for the user to prioritize. User devices 314 can also be configured to modify parameters of alarm analysis system 310 as well as other possible components of system 300, according to some embodiments.

Figure 4:
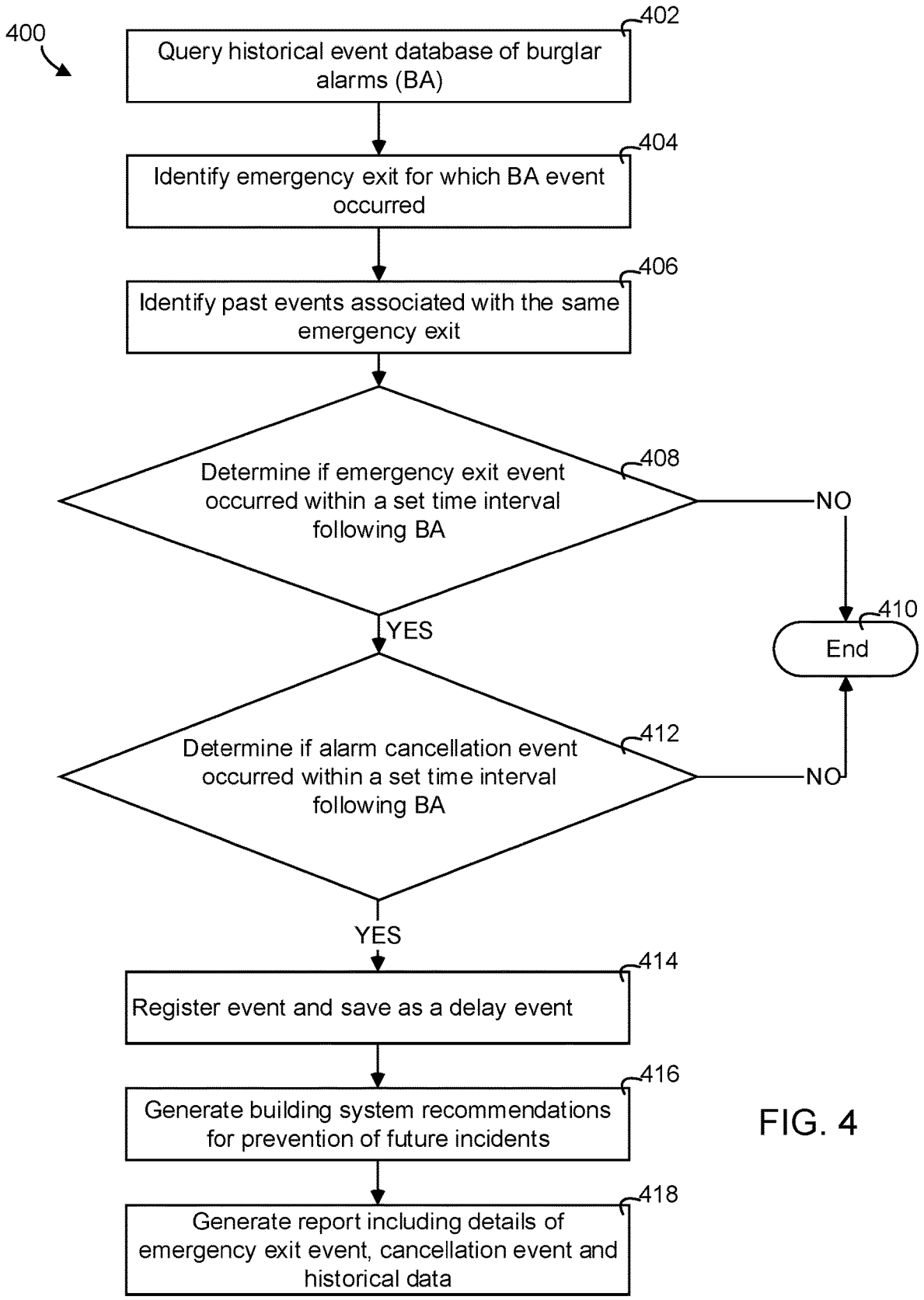
FIG. 4 is a flow diagram of a process of identifying and classifying emergency exit activity and generating recommendations for future actions, according to an exemplary embodiment.

Referring now to FIG. 4, a process 400 of identifying and classifying emergency exit activity and generating recommendations for future actions is shown, according to some embodiments. It should be noted that process 400 can be applied to systems of FIG. 2 and FIG. 3, according to some embodiments. It should also be noted that process 400 is in no way limiting of the features of the present disclosure or the systems of FIG. 2 and FIG. 3.

Process 400 is shown to include querying historical event database of burglar alarms (BA) (step 402), according to some embodiments. In some embodiments, this query can request data from a database or table, such as historical security data 312 of FIG. 2 and FIG. 3, for example. In some embodiments, historical security data 312 of FIG. 2 and FIG. 3 can be stored within system 200 or system 300 for a period of time defined by a user or can be stored for an indefinite amount of time. Depending on the nature of the query of step 402, historical security data 312 can or cannot be included in step 402. In some embodiments, burglar alarms included in the database of step 402 can include data collected from sensors that can be the same as or similar to building exit sensors 330 of FIG. 3.

Process 400 is shown to include identifying an emergency exit for which a BA event occurred (step 404), according to some embodiments. Emergency exit of step 404 can also be a plurality of emergency exits, according to some embodiments. A BA event at an emergency exit such as that of step 404 can be detected by the systems seen in FIG. 2 and FIG. 3, and more specifically such an event can initially be detected by entry system 316 and intrusion system 318 of FIG. 2 or building exit sensors 330 of FIG. 3, as well as other possible components in some embodiments. Emergency exit or plurality of emergency exits of step 404 can include a variety of entry or exit configurations including but not limited to doors, cargo/loading doors, windows, garages, or other means of entry or exit. In some embodiments, BA events can be detected for a zone or one or more emergency exits. Further, BA events can include various different incidents that can result in a BA event. For example, BA events of step 404 can include a door being improperly shut or not shut completely, a malfunction of sensing equipment, an exit or entrance being used improperly or at an improper time, as well as possible forced-entry situations.

Process 400 is shown to include identifying past events associated with the same emergency exit (step 406), according to some embodiments. Past events of step 406 can include or be stored as historical security data 312 and can exist on cloud server 304 of FIG. 2 and/or FIG. 3, according to some embodiments. Past events identified in step 406 can be confined to a specific time period or time interval over a set time, for example a time period of two weeks, or a time interval of 12:00 A.M.-6:00 AM for the month of January. In some embodiments, newer or recently implemented systems may include smaller amounts of data for past events and can include all data rather than data from a select time period. Past events of step 406 can also be similar and/or different events than any events that begin process 400, according to some embodiments. It should be noted that, if desirable for the user, buildings featuring identical structures and/or exits can share past event data of step 406, and in some embodiments data from emergency exits that are uniform in identical buildings can also share data.

Process 400 is shown to include determining if an emergency exit event occurred within a set time interval following BA (step 408), according to some embodiments. In some embodiments, an emergency exit event can include opening and/or closing a door or other component. Time interval of step 408 can vary and can also be set depending on what time interval can be desirable to the user. Additionally, step 408 can apply to emergency exits other than a traditional door. For example, step 408 can also apply to a garage door, a loading/cargo door, or any other possible method of entry or exit included in system 200 of FIG. 2. In some embodiments, other criteria desired by a user and/or operator can associated with step 408 that can impact the determination of whether an emergency exit event occurred as in step 408, including but not limited to specified times of day, tolerance times for the emergency exit, as well as other factors. Should a determination be made that an emergency exit event has not occurred, a decision "NO" will be made in response to step 408.

Process 400 is shown to include a decision made in step 408, for which a determination of "NO" is shown to lead to an end (step 410), according to some embodiments. In some embodiments, step 410 is shown to end a loop of a portion of process 400 and can restart process 400 as well beginning at step 402. It should be noted that step 410 is only reached should a determination of "NO" be made for step 408, indicating that an emergency exit event of step 408 was determined to have not occurred.

Process 400 is shown to include determining if an alarm cancellation event occurred within a set time interval following BA (step 412), according to some embodiments. Alarm cancellation event of step 412 corresponds to the emergency exit event of step 408, and step 412 is only reached as a part of process 400 should an emergency exit event of step 408 be determined to have happened. The cancellation event of step 412 can include various cancellation mechanisms, for example a code being entered by a user to negate the alarm in the approved use of an emergency exit or can also include an exception granted by process 400 for a specific user or a specific time interval, among other possible cancellation mechanisms. For example, in the event of a planned evacuation drill, an emergency exit may experience a cancellation event during the course of the drill or possible in advance of the drill. The time interval of step 412 can be variable and can also be capable of accommodating a time interval desired by the user, according to some embodiments. For example, if a user found it desirable to have a shorter time period outside of business hours than during business hours to accommodate occasional acceptable use of an emergency exit during business hours, this can be configured in some embodiments. According to some embodiments, in the event that a determination of "NO" is not made for step 412 indicating that an alarm cancellation event did not occur within the specified time interval, step 410 is reached which is shown to be the end of the process. In the instance that step 410 is reached, this can lead to restarting the process 400, according to some embodiments.

Process 400 is shown to include registering an event and saving it as a delay event (step 414), according to some embodiments. It should be noted that, in some embodiments, step 414 is only reached as a part of process 400 should an answer of "YES" be determined to step 412 in which a determination is made if an alarm cancellation event occurred within a set time interval following BA. Should a cancellation event of step 412 occur, said event can be saved in step 414 in a variety of ways, according to some embodiments. For example, following a cancellation event said event can be stored within cloud server 304 of FIG. 2 and FIG. 3, or can be stored in another manner according to some embodiments. In some embodiments, the data registered for the event saved can vary according to what a user can find desirable. For example, a user may find it desirable to know which employees had used credentials to enter any restricted areas within a certain time period of the delay event, in which case such data can be saved as a part of step 414.

Process 400 is shown to include generating building system recommendations for prevention of future incidents (step 416), according to some embodiments. In some embodiments, recommendations generated in step 416 can include specifics as to events registered and saved in step 414. In some embodiments, recommendations can be configured to be generated based on specific data that can be saved in step 414. Recommendations can also be sent to user devices 314 of FIG. 2 and FIG. 3 or can be communicated to a user by another means. Recommendations of step 416 can pertain to reducing or eliminating emergency exit events determined to have occurred in steps 412 and 414 and can also be generated by security recommendation generator 338 of FIG. 3, according to some embodiments. For example, in the instance that one or more emergency exit events were occurring in a pattern, step 416 can include generating a recommendation that training be done to address misuse of emergency exits. Or, in some embodiments, for other patterns that can be identified recommendations can include replacing sensors if data collected indicates the possibility of a hardware malfunction.

Process 400 is shown to include generating a report including details of emergency exit event or events, cancellation event or events, and historical data (step 418), according to some embodiments. Step 418 can include security recommendation generator 338 and alarm classifier 340 of FIG. 3, according to some embodiments. Report of step 418 and its details can include data such as a zone for an emergency exit event, a specific emergency exit within that zone, a time stamp for the event, a measure of priority and/or severity, and an indication of any previous events that are relevant as well as other possible pertinent data, according to some embodiments. Additionally, data included in the generated report can vary depending on user and/or operator preferences. Report of step 418 can also be communicated to one or more users via user devices the same as or similar to user devices 314 of FIG. 2 and FIG. 3, according to some embodiments. For example, it can be desirable for a user to have a report generated for every emergency exit event that occurs, and also have reports generated at set time intervals even if an emergency exit event did not occur so as to monitor, identify and quantify the time without emergency exit events. It should also be noted that the report generated in step 418 can be specific to a zone of a building, a building in its entirety, or a system of buildings, according to some embodiments.

It should be noted that while process 400 can apply to systems 200 and 300 of FIG. 2 and FIG. 3, respectively, and can incorporate one or more components of those systems, it is in no way limiting to the systems of FIG. 2 and FIG. 3 and can apply to other systems as well. Additionally, steps of process 400 can be repeated or skipped according to some embodiments and the desired performance of the user for a specific application. Process 400 can also include modifications to accommodate specific user preferences and parameters and can also function differently according to some embodiments.

Figure 5:
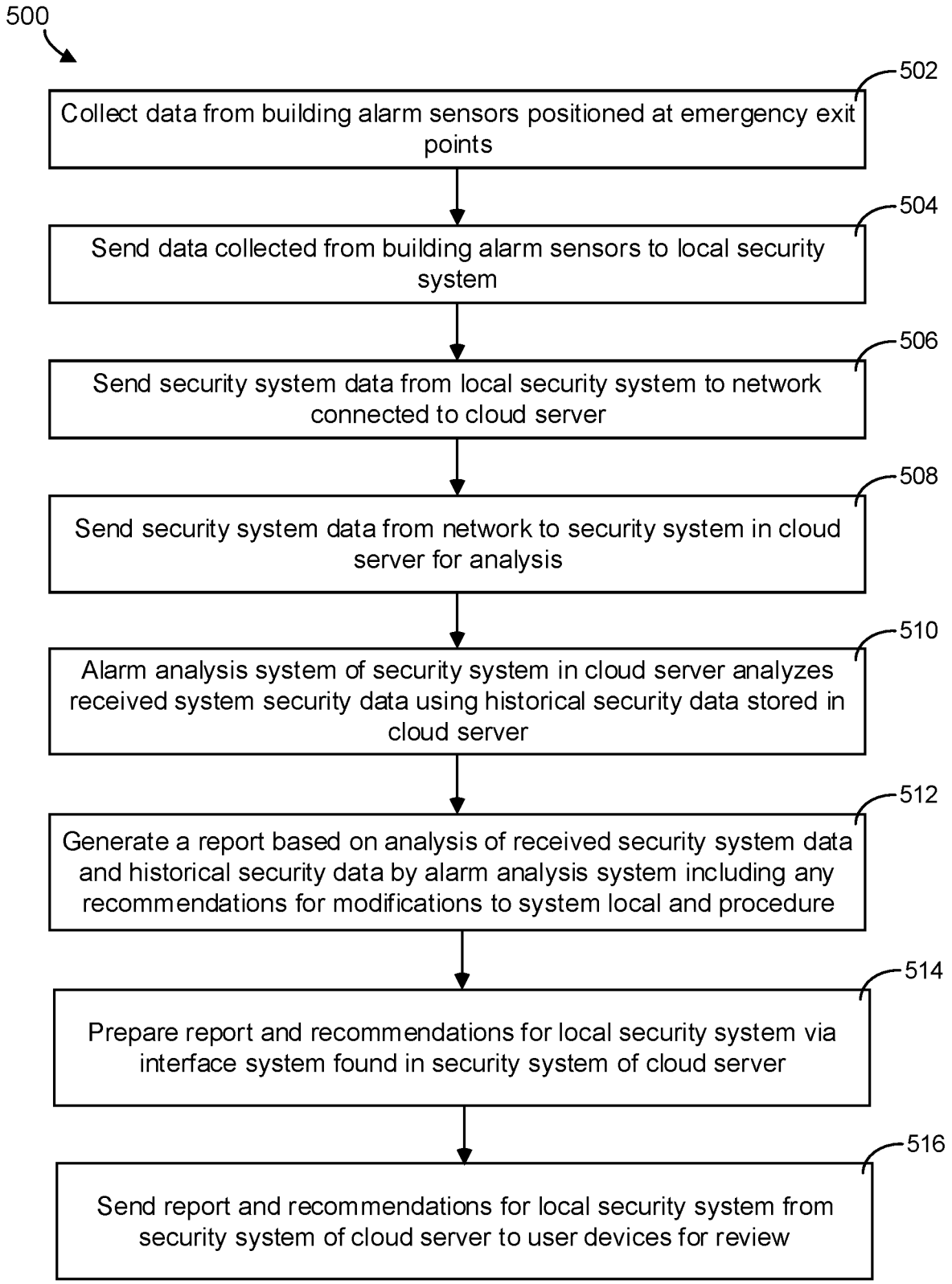
FIG. 5 is a flow diagram of a process of collecting and analyzing emergency exit use data in order to report usage and recommendations, according to an exemplary embodiment.

Referring now to FIG. 5, a process 500 is shown for collecting and analyzing emergency exit use data in order to report usage and recommendations according to some embodiments. Process 500 can be applicable to the systems seen in FIG. 2 and FIG. 3, but also can vary according to some embodiments. It should be noted that process 500 is in no way limiting, and the steps of process 500 can be performed multiple times, skipped, or modified according to some embodiments. It should also be noted that the steps of process 500 can be modified to include steps of process 400 or similar, depending desired user specifications and function, according to some embodiments.

Process 500 is shown to include collecting data from building alarm sensors positioned at emergency exits (step 502), according to some embodiments. Building alarm sensors of step 502 can include components of entry system 316 and intrusion system 318 of FIG. 2 and can also include building exit sensors 330 and fire safety sensors 332 of FIG. 3, according to some embodiments. Additionally, in some embodiments emergency exits of step 502 can include doors, loading/cargo doors, garage entrances and exits, as well as other possible emergency exits depending on user specifications. Data collected from building alarm sensors in step 502 can include time, building zone, specific emergency exit, personnel in close proximity to the emergency exit as well as other possible data, according to some embodiments.

Process 500 is shown to include sending data collected from building alarm sensors to a local security system (step 504), according to some embodiments. Local security system of step 504 can be the same or similar to local security system of 334 of FIG. 2 and FIG. 3, according to some embodiments. Building alarm sensors of step 504 can be those of step 502, according to some embodiments, or can be other sensors. Data sent from building alarm sensors to local security system in step 502 can be similar or the same as the data collected from building alarm sensors in step 502. Local security system of step 504 can be for a single building, or a group of buildings and can also be part of a larger security system, according to some embodiments.

Process 500 is shown to include sending security system data from local security system to network connected to a cloud server (step 506), according to some embodiments. Network of step 506 can be the same as or similar to network 246 of FIG. 2 and FIG. 3, according to some embodiments. In some embodiments, network of step 506 can be shared by more than one security system as well as other possible systems. For example, network of step 506 can be in communication with other local security systems the same as or similar to local security system of 506 and can also be in communication with other security systems as well as other emergency exit systems, according to some embodiments.

Process 500 is shown to include sending security system data from a network to a security system in a cloud server for analysis (step 508), according to some embodiments. In some embodiments, loud server of step 508 can be the same as or similar to cloud server 304 of FIG. 2 and FIG. 3. Cloud server can also be shown to include a security system, which can be the same as or similar to that seen in FIG. 2 and FIG. 3 as security analysis system 306, according to exemplary embodiments. Data sent from security system to cloud server in step 508 can include exemplary data mentioned in the description of step 502 and can originate from security analysis system 306 and intrusion system 318 of FIG. 2, as well as building exit sensors 330 and fire safety sensors 332 of FIG. 3, according to some embodiments. Cloud server of step 508 can also be in communication with multiple networks, such as network 246 of FIG. 2 and FIG. 3, which in turn can be in communication with multiple local security systems such as local security system 334 of FIG. 3, according to some embodiments.

Process 500 is shown to include alarm analysis system of security system in cloud server analyzing received system security data using historical security date stored in cloud server (step 510), according to some embodiments. In some embodiments, alarm analysis system of step 510 can be the same as or similar to alarm analysis system 310 of FIG. 2 and FIG. 3 and can implement a variety of analysis techniques depending on desired user configuration and specific embodiment. Additionally, alarm analysis system of step 510 can also include components such as security recommendation generator 338 and alarm classifier 340 of FIG. 3, according to some embodiments. Alarm analysis system of step 510 can be configured to receive and analyze data for a single building or a system of buildings from cloud server of step 510, according to some embodiments. In some embodiments, historical security data of step 510 can be the same as or similar to historical security data 312 of FIG. 2 and FIG. 3, and as such can include historical security data from one or more buildings or systems.

Process 500 is shown to include generating a report based on analysis of received security system data and historical security data by alarm analysis system including any recommendations for modifications to local system and procedure (step 512), according to some embodiments. In some embodiments, report of step 512 can include recommendations for a single building or for a system of buildings and can depend on desired user configuration. Additionally, report of step 512 can be based on data for a specific time period or time interval, and can also focus on specific employees, departments, building zones, or other factors depending on desired user configuration, according to some embodiments. Recommendations of step 512 can include modification of an emergency exit, additional training for employees on proper emergency exit use, replacement of potentially faulty sensors, as well as other possible recommendations that can focus on emergency exit events, according to some embodiments.

Process 500 is shown to include preparing a report and recommendations for local security system via interface system found in security system of cloud server (step 514), according to some embodiments. Interface system of step 514 can be the same as or similar to interface system 308 of FIG. 2 and FIG. 3, according to some embodiments. In some embodiments, interface system of step 514 can also be included in the cloud server and can further be included within security system of cloud server. Data inputted to interface system of step 514 from alarm analysis system of step 512 can vary depending on desired user configuration and as such, behavior of interface system can vary accordingly in some embodiments. For example, if a user desires a report generated by alarm analysis system of step 512 to be for one specific building rather than a system of buildings, interface system of step 514 can prepare an interface for a report for a single building differently than if the user desired a report focusing on multiple buildings or a system of buildings. Interface system of step 514 can also vary in function depending on the hardware with which it is communicating, according to some embodiments. For example, interface system of step 514 can perform differently when preparing data to be consumed by a user on a handheld screen than for other methods by which a user can consume the data.

Process 500 is shown to include sending a report and recommendations for local security system from security system of cloud server to user devices for review (step 516), according to some embodiments. User devices of step 516 can be the same as or similar to user devices 314 of FIG. 2 and FIG. 3, according to some embodiments. In some embodiments, report of step 516 can be sent from interface system to user devices differently, for example if within close proximity a Bluetooth technology or similar can be used, while in methods such as email or similar can be employed in sending the report and corresponding data.

User devices of step 16 can be configured to desired user specifications, according to some embodiments. For example, for a system of buildings it can be desirable to have different reports for different buildings sent to different user devices, in which case a user can desire the interface system distinguish specific user devices as qualified to receive a generated report so as to maximize efficiency or to keep data confidential.

It should be noted that while process 500 can apply to the systems of FIG. 2 and FIG. 3 and can incorporate one or more components of those systems, it is in no way limiting to the systems of FIG. 2 and FIG. 3 and can apply to other systems as well. Additionally, steps of process 500 can be repeated or skipped depending on desired performance of the user for a specific application. Process 500 can also include modifications to accommodate specific user preferences or can function differently according to some embodiments.

Referring now to FIG. 6, a user interface for a system generating a report on emergency exit usage over a set time duration is shown, according to some embodiments. Interface 600 can be generated by alarm analysis system 310 of FIG. 2 and FIG. 3 and can be prepared for user devices by interface system 308, according to some embodiments. In some embodiments, the contents of interface 600 can vary depending on the configuration desired by the user. For example, if interface 600 were to be generated for a system of buildings, it may be configured differently than if it were to be generated for a single building. It should be noted that, according to some embodiments, various parameters of interface 600 can vary such as the data reported, the regions for which the data is reported, the time parameters for the data to be displayed, possible recommendations, as well as other possible parameters.

Interface 600 is shown to include an event report 602, according to some embodiments. Event report 602 can be generated according to the desired specifications of a user and can also be modified, according to some embodiment. In some embodiments, event report 602 can specifically pertain to a building or system of buildings. For example, event report 602 can be generated based on data received from system 300 of FIG. 3 or a similar system, and as such can include a single building or a system of buildings. Event report includes data log 612, according to some embodiments. In some embodiments, data log 612 can include data collected by a security system the same as or similar to system 200 of FIG. 2, with the data more specifically being collected by components such as entry system 316 and intrusion system 318 of FIG. 2 and building exit sensors 330 and fire safety sensors 332 of FIG. 3. Data log can include a time stamp 604, a zone 606, an exit 608, and an indication of a cancellation event 610, according to some embodiments.

Interface 600 is shown to include a time period 614, new events 616, and a recommendation status 618, according to some embodiments. In some embodiments, time period 614 can vary according to the desired configuration of a user. For example, a user may desire data log 612 include data from a set period such as a 14-day period as seen in the exemplary embodiment of FIG. 2. Zone 606 and exit 608 can be configured depending on a building or system of buildings for which interface 600 is generating event report 602, according to some embodiments. For example, interface 600 can indicate a specific building where an event occurred in addition to a zone 606 and an exit 608, according to some embodiments. Additionally, new events 616 can be based on time period 614, according to some embodiments. For example, if time period 614 were desired to be three months, new events 616 can indicate the total number of events that occurred over the course of the three-month period of time period 614. In some embodiments, recommendation status 618 can serve as an indication that the data of data log 612 has been processed and that a completed recommendation can be prepared. Recommendation indicated by recommendation status can have been prepared by a component the same as or similar to security recommendation generator 338 of FIG. 3, according to some embodiments.

Interface 600 also includes a back option 620, according to some embodiments. Back option 620 can offer a user an option to view event reports such as event report 602 for another building or system of buildings, according to some embodiments. It should be noted that not all embodiments of interface 600 can include multiple buildings and systems, and as such the functionality of back option 620 can vary according to some embodiments.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements can be reversed or otherwise varied, and the nature or number of discrete elements or positions can be altered or varied. Accordingly, all such modifications are intended to be included within the scope of the present disclosure. The order or sequence of any process or method steps can be varied or re-sequenced according to alternative embodiments. Other substitutions, modifications, changes, and omissions can be made in the design, operating conditions and arrangement of the exemplary embodiments without departing from the scope of the present disclosure.

Although the figures show a specific order of method steps, the order of the steps can differ from what is depicted. Also, two or more steps can be performed concurrently or with partial concurrence. Such variation will depend on the software and hardware systems chosen and on designer choice. All such variations are within the scope of the disclosure. Likewise, software implementations could be accomplished with standard programming techniques with rule-based logic and other logic to accomplish the various connection steps, processing steps, comparison steps and decision steps.

What is claimed is:

1. A rules-based emergency exit misuse identification system, the rules-based emergency exit misuse identification system comprising:

one or more cloud servers configured to store instructions that, when executed on one or more security systems, cause the one or more security systems to:

receive emergency data from a plurality of sensors for a plurality of emergency exits, the emergency data indicating activity of the plurality of emergency exits;

identify one or more emergency exits for which a burglar alarm event occurred;

identify past burglar alarm events associated with the one or more emergency exits for which the burglar alarm event occurred;

determine if the burglar alarm event qualifies as a delay event;

register and save the emergency data including the burglar alarm event if the burglar alarm event qualifies as the delay event;

generate system recommendations for prevention of future delay events for the plurality of emergency exits; and generate a report including details of the delay event, emergency exit activity and historical data collected from the plurality of sensors for the plurality of emergency exits.

2. The rules-based emergency exit misuse identification system of claim 1, wherein the instructions cause the one or more security systems to: rules-based emergency exit misuse identification determine if a door open event or a door close event occurred within a first defined time period of the burglar alarm event;

if the door open event or the door close event occurred within the first defined time period of the burglar alarm event, determine if an alarm cancellation event occurred within a second defined time period of the burglar alarm event; and if the alarm cancellation event occurred within the second defined time period of the burglar alarm event, classify the burglar alarm event as the delay event.

3. The rules-based emergency exit misuse identification system of claim 2, wherein the instructions cause the one or more security systems to classify the burglar alarm event as a non-delay event if it is determined that the door open event or the door close event occurred within the first defined time period of the burglar alarm or the alarm cancellation event occurred within the second defined time period of the burglar alarm event.

4. The rules-based emergency exit misuse identification system of claim 3, wherein the first defined time period within which the door open event or the door close event occurs is adjustable.

5. The rules-based emergency exit misuse identification system of claim 3, wherein the second defined time period within which the alarm cancellation event occurs is adjustable.

6. The rules-based emergency exit misuse identification system of claim 1, wherein the system recommendations generated in response to the burglar alarm event qualifying as the delay event are generated by analyzing the emergency data collected from the plurality of sensors for the plurality of emergency exits.

7. The rules-based emergency exit misuse identification system of claim 1, wherein the report generated in response to the burglar alarm event qualifying as the delay event are generated by analyzing the emergency data collected from the plurality of sensors for the plurality of emergency exits.

8. The rules-based emergency exit misuse identification system of claim 1, wherein the instructions cause the one or more security systems to communicate the system recommendations to one or more user devices.

9. The rules-based emergency exit misuse identification system of claim 1, wherein the instructions cause the one or more security systems to communicate the report to one or more user devices.

10. The rules-based emergency exit misuse identification system of claim 1, wherein the emergency data from the plurality of sensors for the plurality of emergency exits indicating the activity of the plurality of emergency exits is transmitted to the one or more cloud servers by a network.

11. A method for identifying misuse of emergency exits comprising:

configuring one or more cloud servers to store instructions that, when executed on one or more security systems, comprise:

receiving emergency data from a plurality of sensors for a plurality of emergency exits, the emergency data indicating activity of the plurality of emergency exits;

identifying one or more emergency exits for which a burglar alarm event occurred;

identifying past burglar alarm events associated with the one or more emergency exits for which the burglar alarm event occurred;

determining if the burglar alarm event qualifies as a delay event;

registering and saving the emergency data including the burglar alarm event if the burglar alarm qualifies as the delay event;

generating system recommendations for prevention of future delay events for the plurality of emergency exits; and generating a report including details of the delay event, emergency exit activity and historical data collected from the plurality of sensors for the plurality of emergency exits.

12. The method of claim 11, wherein the instructions for the one or more security systems include:

determining if a door open event or a door close event occurred within a first defined time period of the burglar alarm event;

if the door open event or the door close event occurred within the first defined time period of the burglar alarm event, determining if an alarm cancellation event occurred within a second defined time period of the burglar alarm event; and if the alarm cancellation event occurred within the second defined time period of the burglar alarm event, classifying the burglar alarm event as the delay event.

13. The method of claim 12, wherein the instructions for the one or more security systems include classifying the burglar alarm event as a non-delay event if it is determined that the door open event or the door close event occurred within the first defined time period of the burglar alarm or the alarm cancellation event occurred within the second defined time period of the burglar alarm event.

14. The method of claim 13, wherein the instructions for the one or more security systems include adjusting the first defined time period within which the door open event or the door close event occurs.

15. The method of claim 13, wherein the instructions for the one or more security systems include adjusting the second defined time period within which the alarm cancellation event occurs.

16. The method of claim 11, wherein the instructions for the one or more security systems include, in response to the burglar alarm event qualifying as the delay event, generating the system recommendations by analyzing the emergency data collected from the plurality of sensors for the plurality of emergency exits.

17. The method of claim 11, wherein the instructions for the one or more security systems include, in response to the burglar alarm event qualifying as the delay event, generating the report by analyzing the emergency data collected from the plurality of sensors for the plurality of emergency exits.

18. The method of claim 11, wherein the instructions for the one or more security systems include communicating the system recommendations to one or more user devices.

19. The method of claim 11, wherein the instructions for the one or more security systems include communicating the report to one or more user devices.

20. A rules-based emergency exit misuse identification system, the rules-based emergency exit misuse identification system comprising:

one or more cloud servers configured to store instructions;

one or more security systems configured to execute the instructions stored on one or more memory devices to:

receive emergency data from a plurality of sensors for a plurality of emergency exits, the emergency data indicating activity of the plurality of emergency exits;

identify one or more emergency exits for which a burglar alarm event occurred;

identify past burglar alarm events associated with the one or more emergency exits for which the burglar alarm event occurred;

determine if the burglar alarm event qualifies as a delay event;

register and save the emergency data including the burglar alarm event if the burglar alarm qualifies as the delay event;

generate system recommendations for prevention of future delay events for the plurality of emergency exits; and generate a report including details of the delay event, emergency exit activity and historical data collected from the plurality of sensors for the plurality of emergency exits.

* * * * *